US010786136B2

(12) United States Patent
Brugora et al.

(10) Patent No.: US 10,786,136 B2
(45) Date of Patent: Sep. 29, 2020

(54) WRINGING DEVICE FOR A MOP

(71) Applicant: Carl Freudenberg KG, Weinheim (DE)

(72) Inventors: Alessandro Brugora, Cernusco sul Naviglio (IT); Uwe Dingert, Absteinach (DE); Norbert Weis, Weinheim (DE)

(73) Assignee: CARL FREUDENBERG KG, Weinheim (DE)

( * ) Notice: Subject to any disclaimer, the term of this patent is extended or adjusted under 35 U.S.C. 154(b) by 98 days.

(21) Appl. No.: 16/063,704

(22) PCT Filed: Dec. 19, 2016

(86) PCT No.: PCT/EP2016/081739

§ 371 (c)(1),
(2) Date: Jun. 19, 2018

(87) PCT Pub. No.: WO2017/108687

PCT Pub. Date: Jun. 29, 2017

(65) Prior Publication Data

US 2018/0368650 A1 Dec. 27, 2018

(30) Foreign Application Priority Data

Dec. 21, 2015 (DE) ..... 10 2015 016 459
Dec. 5, 2016 (DE) ..... 10 2016 014 403

(51) Int. Cl.
*A47L 13/58* (2006.01)

(52) U.S. Cl.
CPC ..... *A47L 13/58* (2013.01)

(58) Field of Classification Search
CPC ..... A47L 13/58; A47L 13/59; A47L 13/60; Y10S 15/09
USPC ..... 15/260–263, DIG. 9
See application file for complete search history.

(56) References Cited

U.S. PATENT DOCUMENTS 3,280,418 A * 10/1966 Schonberger ..... A47L 13/58 15/261
5,615,446 A 4/1997 Cetnarowski
5,974,621 A * 11/1999 Wilen ..... A47L 13/59 15/260
6,065,175 A * 5/2000 Tejerina ..... A47L 13/12 15/116.1
2002/0095739 A1 7/2002 Dingert
2003/0167589 A1 9/2003 Dingert et al.
2015/0282689 A1* 10/2015 Ngan ..... A47L 13/58 15/260
2016/0183760 A1 6/2016 Weis et al.

FOREIGN PATENT DOCUMENTS

CN 203000861 U 6/2013
DE 29922580 U1 3/2000
DE 10210569 A1 9/2003

(Continued)

*Primary Examiner* — Mark Spisich
(74) *Attorney, Agent, or Firm* — Leydig, Voit & Mayer, Ltd.

(57) ABSTRACT

A wringer device for a mop includes a basket-like receptacle in which the mop can be wrung out by being pushed in and a support for fastening the wringer device in a mop bucket. The receptacle can be guided in the support such that the receptacle can be moved in translation in an insertion direction of the mop.

7 Claims, 12 Drawing Sheets

(56) References Cited

FOREIGN PATENT DOCUMENTS

| | | | |
|---|---|---|---|
| DE | 202014005331 | U1 | 7/2014 |
| DE | 102013112055 | B3 | 4/2015 |
| EP | 0489237 | A1 | 6/1992 |
| EP | 1224901 | A2 | 7/2002 |
| EP | 1860983 | B1 | 12/2007 |
| EP | 2384682 | A2 | 11/2011 |
| EP | 2389850 | A1 | 11/2011 |

* cited by examiner

Detail X

Detail X
Schnitt AA

WRINGING DEVICE FOR A MOP

CROSS-REFERENCE TO PRIOR APPLICATIONS

This application is a U.S. National Phase application under 35 U.S.C. § 371 of International Application No. PCT/EP2016/081739, filed on Dec. 19, 2016, and claims benefit to German Patent Application No. DE 10 2015 016 459.7, filed on Dec. 21, 2015, and German Patent Application No. DE 10 2016 014 403.3, filed on Dec. 5, 2016. The International Application was published in German on Jun. 29, 2017 as WO 2017/108687 under PCT Article 21(2).

FIELD

The invention relates to a wringer device for a mop, comprising a basket-like receptacle in which the mop can be wrung out by means of being pushed in, and a support for fastening to the wringer device in a mop bucket.

BACKGROUND

A wringer device of this kind is known from DE 102 10 569 A1 for example. Mops of this kind are suitable for wet mops or for flat mops, in which the mop cover is fastened to the flat mop such that it cannot detach automatically. In order to be wrung out, the mop is introduced into the receptacle, the mop cover hanging down from the flat mop in a loop in order to be wrung out.

The receptacle comprises basket-like or sieve-like recesses, such that the water that is pressed out of the mop cover or the wet mop when the mop is pushed into the receptacle drips through the apertures or recesses of the receptacle and into the mop bucket.

In particular, mop covers for flat mops that consist of synthetic textiles can be compressed only a little. While the mop cover is pressed into the wringer device, the low compressibility leads to a very sharp increase in force at the end of the pressing distance. As a result, the user does not receive clear feedback regarding the compression of the mop cover, which makes it more difficult to correctly meter the pressing force and to achieve a desired degree of wringing.

SUMMARY

In an embodiment, the present invention provides a wringer device for a mop, comprising: a basket-like receptacle in which the mop is configured to be wrung out by being pushed in; and a support configured to fasten the wringer device in a mop bucket, wherein the receptacle is configured to be guided in the support such that the receptacle can be moved in translation in an insertion direction of the mop.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
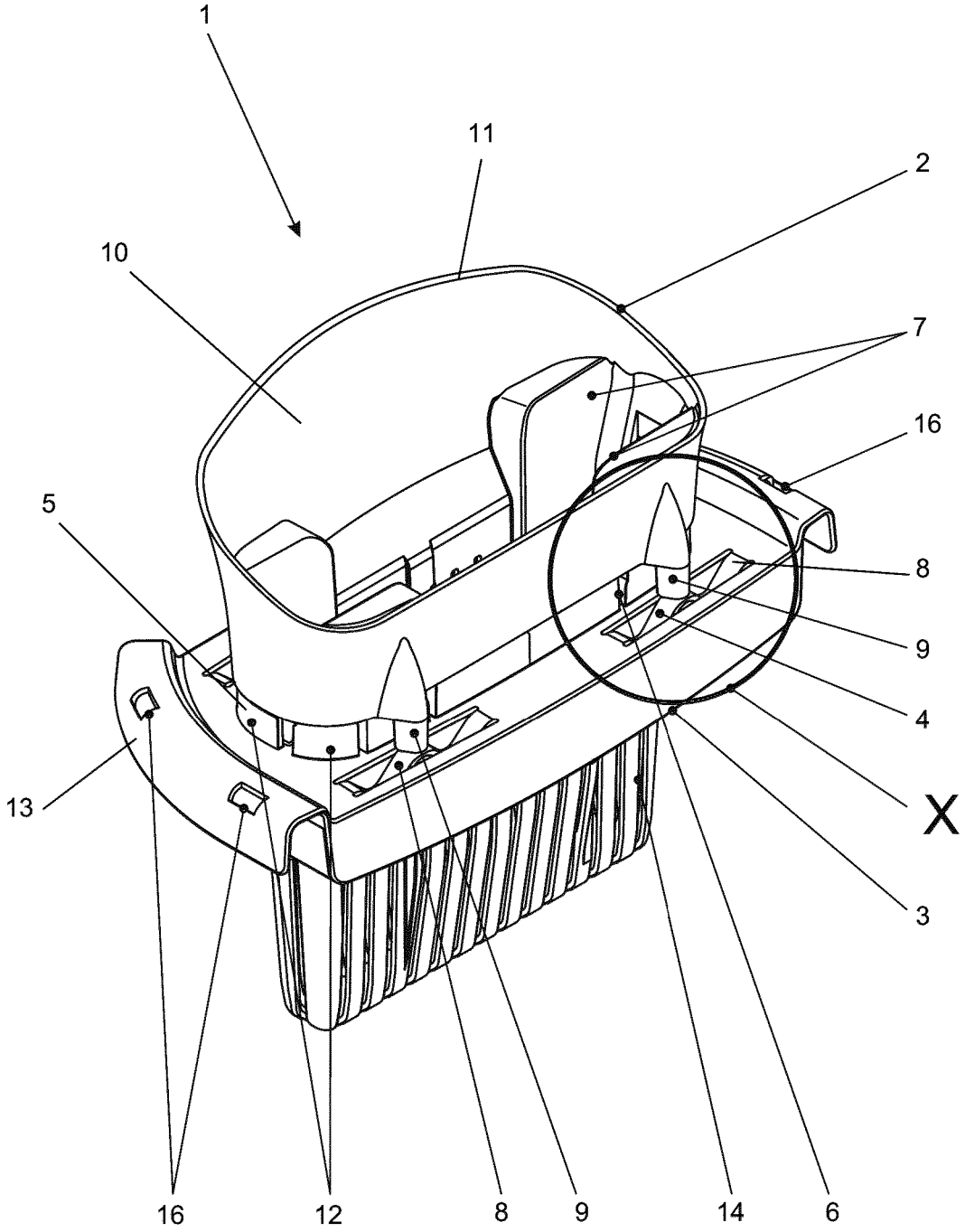
FIG. 1 is a three-dimensional view of the wringer device.

In an embodiment of the present invention, the receptacle is guided in the support such that the receptacle can be moved in translation in the insertion direction of the mop. As a result, when the receptacle moves, a mop is pushed translationally into the receptacle, towards the bottom of the mop bucket. This means that the user has to push the mop a long way into the receptacle in order to wring out a mop cover. As a result, the user receives feedback as to whether sufficient squeezing force for wringing out the mop cover has already been achieved, even in the case of mop covers that can be compressed only a little.

The translational movement of the receptacle preferably occurs counter to the force of a spring. As a result, the press-in force increases constantly when the mop is pushed into the receptacle. Unlike in the case of compressible mop covers that are pushed into a rigid receptacle, the resistance to the pushing increases only gradually, and therefore it is possible to very carefully meter the procedure of wringing out the mop cover, and the user receives feedback regarding the extent to which the mop cover is already sufficiently wrung out.

Advantageously, a guide is provided that allows the translational movement of the receptacle. The guide prevents the receptacle from tilting or even being rotatable in the support. As a result, the mop can be pushed into the receptacle in a precise manner. Furthermore, this results in a stable construction of the wringer device.

The guide may consist of columnar projections and congruent depressions or apertures. According to a first embodiment, the columnar projections are formed by the support and the depressions are made in the receptacle. In this case, the projections and depressions are formed such that the projections slide along in the depressions during the pushing in process. As a result, only translational movement of the receptacle relative to the support is possible.

According to an alternative embodiment, the columnar projections are again formed by the support. Apertures are made in the receptacle, through which apertures the projections protrude. In this embodiment, the projections assume two functions, in that the projections allow a translational movement of the receptacle relative to the support, and in that the wet mop pushed into the receptacle is also guided. During the translational movement of the receptacle, the projections slide back and forth in the apertures. At the same time, the wet mop rests on the projections and is guided into the inside of the receptacle. This embodiment is particularly space-saving on account of the lack of depressions, and therefore the inner diameter of the receptacle can be increased. As a result, bulky wet mops can be wrung out in the wringer device and the wet mops can be pushed deeper into the receptacle.

Preferably, spring elements are provided which are deformed during relative movement of the receptacle when the mop is pushed in. Said spring elements bring about the translational movement of the receptacle counter to the force of a spring. In this case, the spring elements may be provided in the receptacle or in the support. In an advantageous embodiment, the spring elements are arranged in the support.

In this case, the spring elements may be formed integrally and in one piece from the support. The spring elements can thus be provided in the support in a particularly cost-effective manner. Furthermore, the assembly outlay for assembling the wringer device is reduced.

The spring elements may be assigned punching members which deform the spring members when the receptacle moves. The punches are preferably designed so as to come into contact with the spring elements as soon as a mop is pushed into the receptacle. The punches bring about defined deformation, and so clear feedback to the user regarding the degree of pressing is possible. Depending on the arrangement of the spring elements, the punching members are assigned to either the receptacle or the support.

In addition, visual indication means may be provided. For this purpose, it is conceivable for a pointer to be provided on the holder, which pointer is associated with a dial attached to the receptacle. While the mop cover is being pushed in, i.e. when the receptacle moves relative to the support, the dial slides past the pointer. In this case, the dial may be provided with markers which signal when the optimum pressing force has been reached, according to the soiling and the type of the floor to be cleaned. For example, the mop cover should be charged with a smaller amount of fluid in order to clean parquet flooring, while the amount of fluid may be greater for cleaning tiles. Accordingly, a first marker can indicate the presence of the optimum pressing force for cleaning tiles. A second marker can indicate the presence of the optimum pressing force for laminate flooring. A third marker can indicate the presence of the optimum pressing force for parquet flooring. When the third marker is reached, the spring element is almost fully deformed, and the receptacle has moved almost completely towards the support. Accordingly, the mop cover is wrung out to a maximum amount in this position.

The support can be held in the support in an anti-loss manner by means of snap-in hooks. In this case, the snap-in hooks are formed such that a translational movement of the receptacle relative to the support is always possible. However, the snap-in hooks prevent the receptacle from being completely released from the support; the receptacle is thus held on the support in an anti-loss manner by means of the snap-in hooks.

The opening may be provided with a funnel-shaped rim that is higher on one side. In this case, the higher rim is preferably assigned to the side remote from the insertion direction of the mop. This simplifies and improves the insertion of the mop and the funnel function of the receptacle.

A rest may be assigned to the wringer device. In this case, the rest may be molded either into the support or into the receptacle. A simple embodiment of the rest is formed by a semicircular depression that is molded into the support or into the receptacle. The rest is used for temporarily fixing mops in place. In this case, the rest is preferably arranged such that the mop can be placed in the mop bucket and is held there. In this respect, the rest allows for tilt-free positioning of the mop when said mop is placed in the mop bucket.

The drawings show a wringer device 1 for a mop. In this case, the wringer device 1 is designed such that it is preferably suitable for mops in the form of a flat mop having a foldable mop plate on which a mop cover can be wrung out in the wringer device 1 when hanging down from the mop plate in a loop.

The wringer device 1 comprises a basket-like receptacle 2 in which the mop can be wrung out by means of being pushed in. In order to be wrung out, the mop is introduced into the receptacle 2. By means of being pushed into the receptacle 2, the mop cover of the mop is wrung out by compression, and excess water passes from the receptacle 2 and into the mop bucket, through the slits 14 or other apertures made in the receptacle 2. In the present embodiment, the opening 10 of the receptacle 2 has a rectangular cross-section.

The opening 10 of the receptacle 2 is equipped with a funnel-shaped rim 11 in order to make it simpler to introduce the mop. In this case, the rim 11 is higher on one side, along one longitudinal edge. The higher portion of the rim 11 is assigned to the rim of the mop bucket, and the lower portion of the rim 11 is assigned to the center of the mop bucket. As a result, the mop cover can be introduced into the receptacle 2 in a particularly reliable and simple manner.

The receptacle 2 is assigned to a support 3 that is designed for fastening the wringer device 1 in a mop bucket. For this purpose, the support 3 comprises a fixing portion 13 in the rim region, at least in portions, which fixing portion is formed as a bent-over rim in the present embodiment. Furthermore, the fixing portion 13 is provided with snap locks 16 such that the wringer device 1 can be fastened to the mop bucket in an anti-loss manner.

The receptacle 2 is guided in the support 3 such that the receptacle 2 can be moved in translation in the insertion direction of the mop. For this purpose, a guide 5 is provided which exclusively permits a translational movement of the receptacle 2 relative to the support 3.

In the embodiment according to FIGS. 1 to 8, the guide 5 consists of columnar projections 6 and depressions 7 that are congruent to the projections 6. The projections 6 are formed integrally and in one piece from the support 3. The depressions 7 are molded integrally and in one piece into the receptacle 2.

In the embodiment according to FIGS. 9 to 12, the guide 5 is formed by columnar projections 6 which are formed integrally and in one piece from the support 3, and by apertures 15 which are made in the receptacle 2 and through which the projections 6 protrude into the inside of the receptacle 2.

When not loaded, the receptacle 2 remains in a first position, spaced apart from the base of the support 3. During the wringing out process, the receptacle 2 moves towards the support 3 until the receptacle 2 finally reaches a second position in contact with the support 3, against stops or the like. In this case, it is conceivable in particular for the end faces of the projections 6 to come into contact with the boundary of the depressions 7. Overall, during the wringing out process, the receptacle 2 moves in towards the mop bucket, while the support 3 does not change position relative to the mop bucket.

The mop is pushed into the receptacle 2 counter to the force of a spring 4. For this purpose, spring elements 8 are provided which are deformed during relative movement of the receptacle 2 when the mop is pushed in. The spring elements 8 are formed integrally and in one piece from the support 3. For this purpose, apertures are made in the receptacle 2, in which apertures serpentine spring elements 8 are provided.

The spring elements 8 formed in the support 3 are assigned punching members 9 which deform the spring elements 8 when the receptacle 2 moves. The punching members 9 are formed integrally and in one piece from the receptacle 2. During the wringing out process, the punching members 9 come into contact with the serpentine spring elements 8, the spring elements 8 being formed such that a central elevation of a spring element 8 interacts with a punching member 9. In this case, the spring element 8 is deformed, and the spring force resulting therefrom counteracts the pressing-in of the mop.

As a result of the spring constant of the spring elements 8, the spring force counteracting the pressing-in of the mop increases continuously and gradually, and the user receives feedback regarding the wringing out procedure.

An indication device may be provided in addition. The indication device signals the amount by which the receptacle 2 has been displaced relative to the support 3. For this purpose, a pointer may be arranged on the support 3 and a dial on the receptacle 2, or vice versa.

The receptacle 2 is held in the support 3 in an anti-loss manner by means of snap-in hooks 12. In this case, the receptacle 2 can move translationally with respect to the support 3, within specified limits. However, the snap-in hooks 12 prevent the receptacle 2 from being unintentionally released from the support 3.

The support 3 is assigned a rest which is formed integrally and in one piece from the support 3. In an advantageous embodiment, the rest consists of a semi-circular depression that is made in the support 3. As a result, the mop can be placed in the mop bucket and is held by the rest so as not to tilt.

The receptacle 2 and the support 3 consist of injection-moldable plastics material; of polypropylene (PP) in this embodiment.

FIG. 1 is a three-dimensional view of the wringer device 1.

Figure 2:
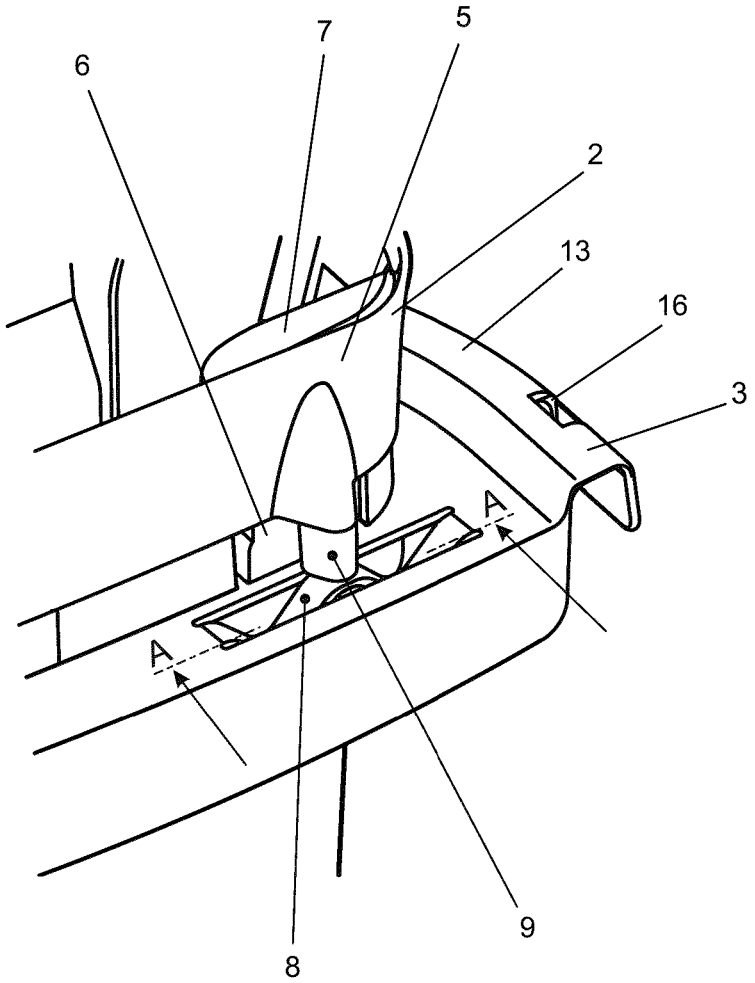
FIG. 2 shows a detail of the spring arrangement between the support and the receptacle.

FIG. 2 shows a detail of the region of the wringer device 1 in which a spring element 8 and a punching member 9 are arranged. In this embodiment, the spring element 8 is molded in one piece and integrally into the support 3, and the punching member 9 is molded into the receptacle 2. When not loaded, the punching members 9 rest on the spring elements 8 without substantially deforming said elements.

Figure 3:
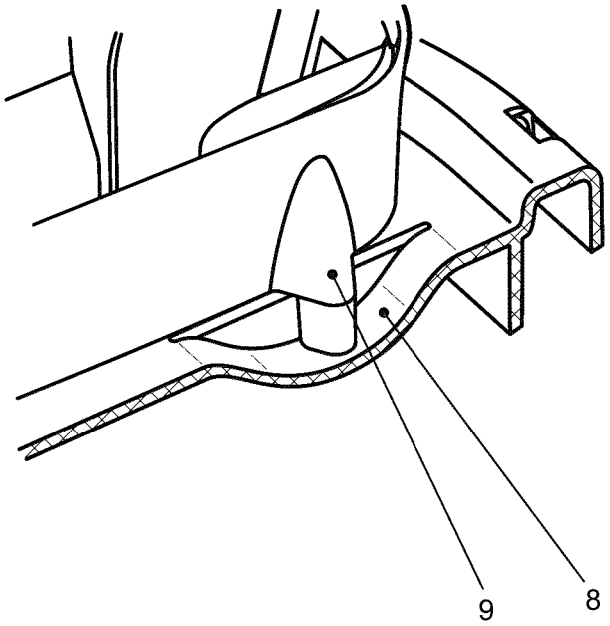
FIG. 3 shows a detail of the spring arrangement when deflected.

In contrast to FIG. 2, FIG. 3 shows the described region when loaded. If a mop is pushed into the receptacle 2, said receptacle moves translationally towards the support 3. In the process, the punching members 9 push against the spring elements 8 and deform said elements. In the present embodiment, the serpentine spring element 8 is deformed to form an arc. The spring element 8 is formed as a clicker and, when fully deflected, has a metastable state. As a result, the spring force decreases again when fully deflected, and therefore the wringer device 1 is more comfortable to operate overall.

Figure 4:
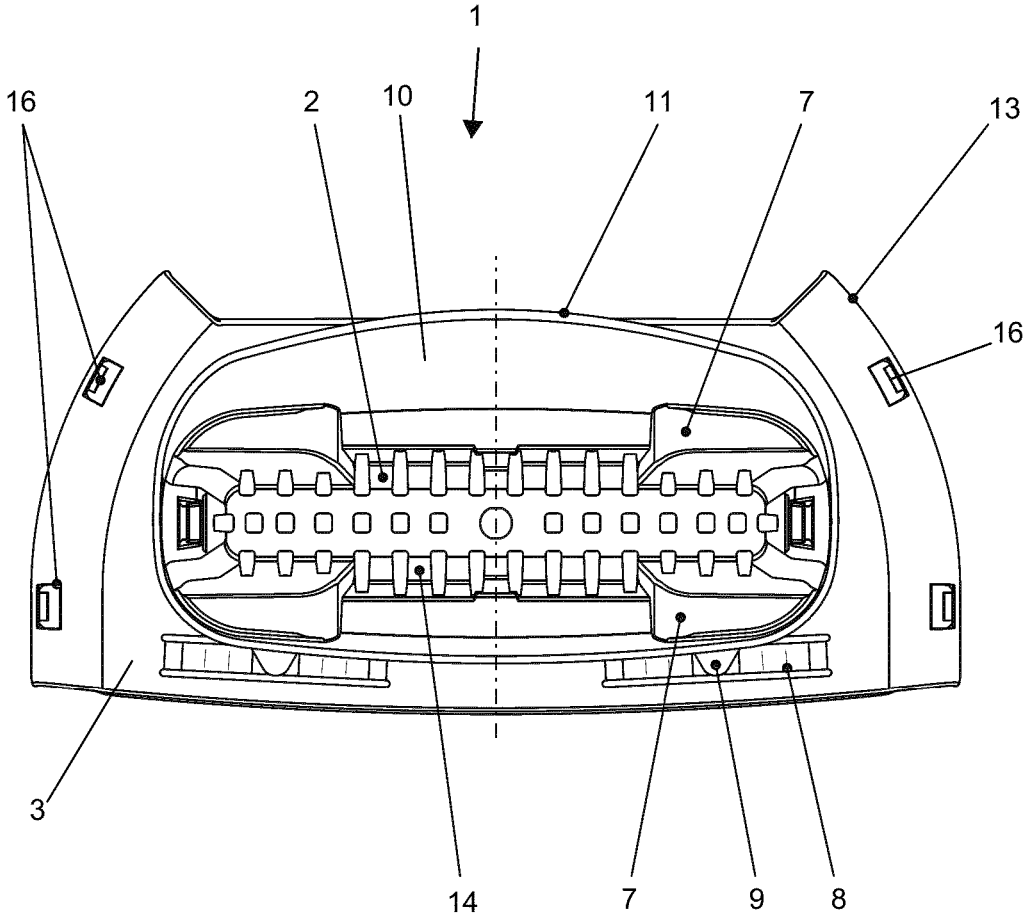
FIG. 4 is a plan view of the wringer device.

FIG. 4 is a plan view of the wringer device 1. The slits 14 and passages made in the receptacle 2, through which the wrung-out cleaning fluid can pass into the mop bucket, can be seen in particular.

Figure 5:
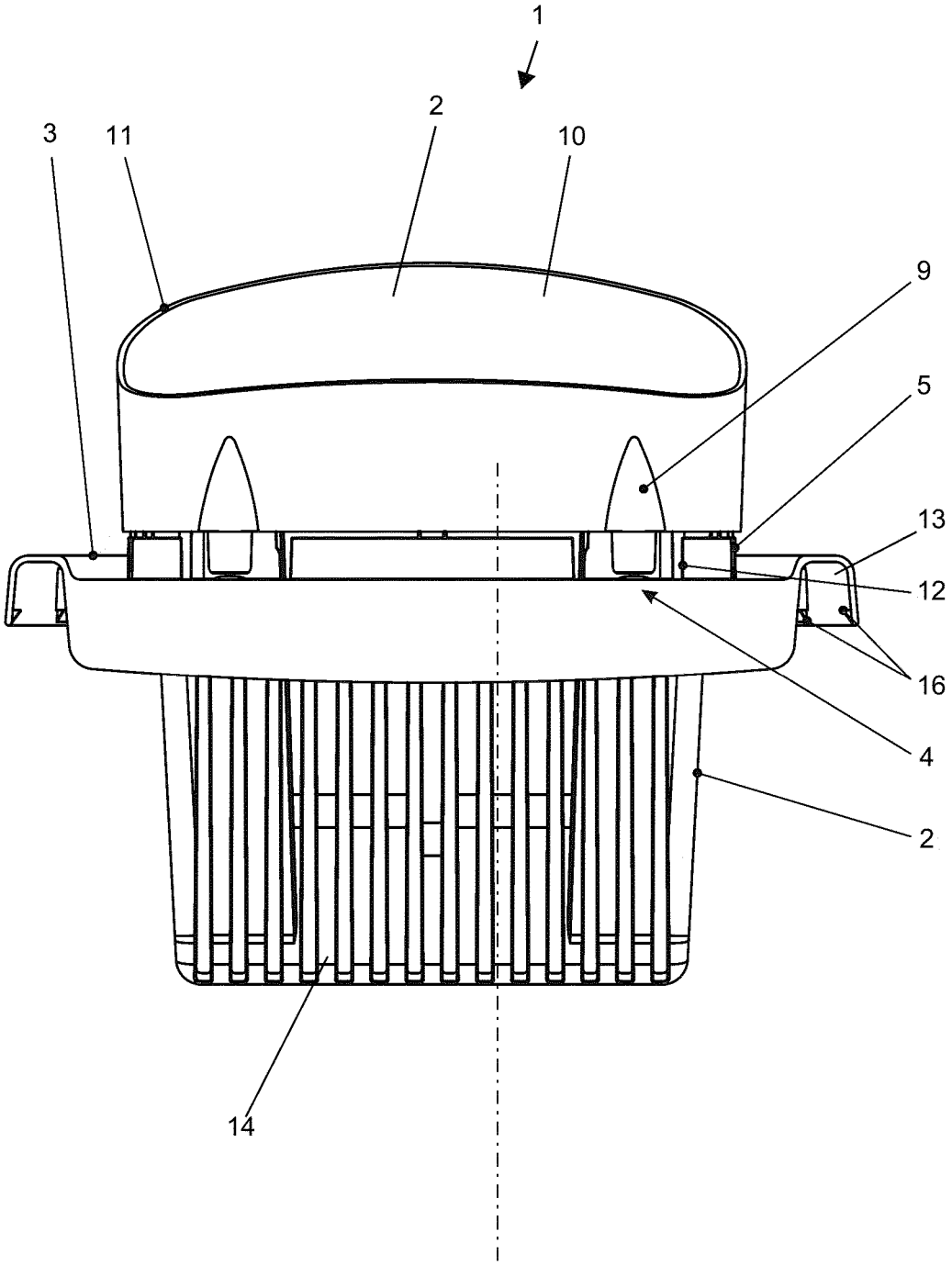
FIG. 5 is a front view of the wringer device.
Figure 6:
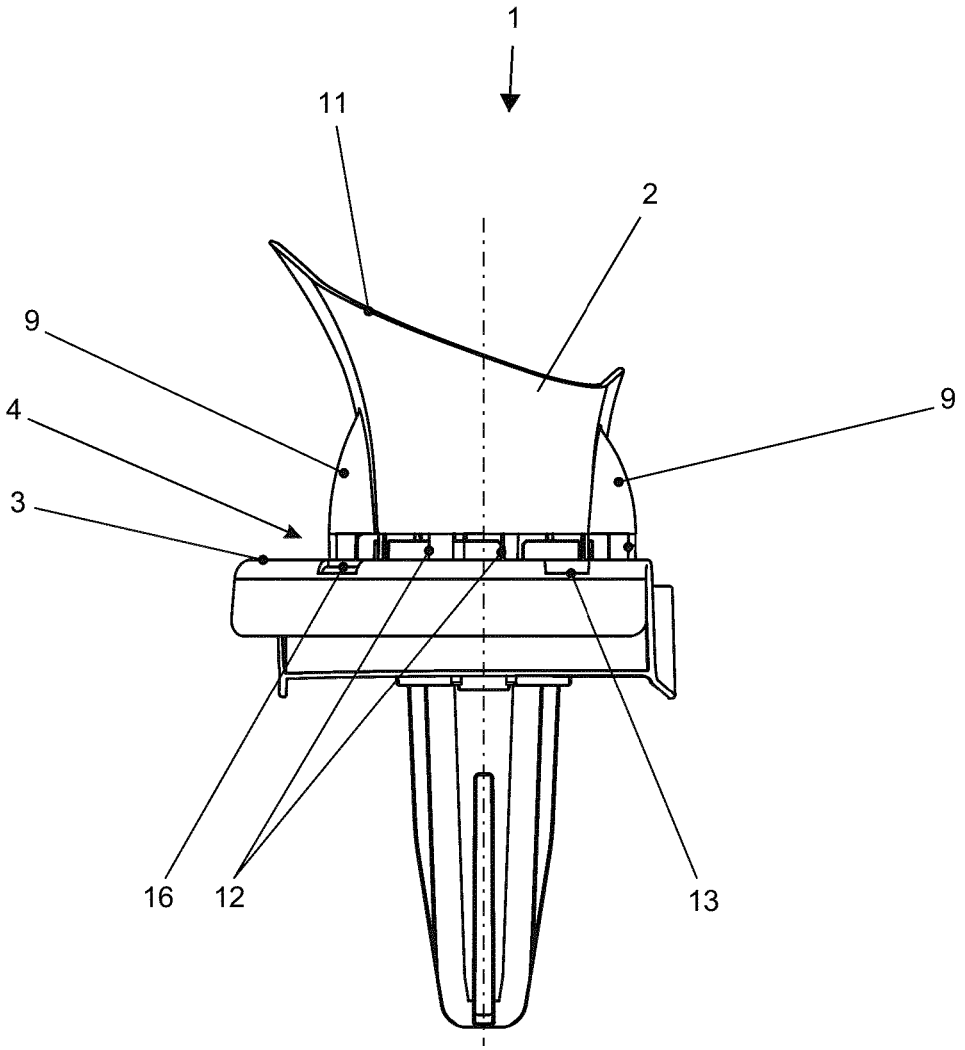
FIG. 6 is a side view of the wringer device.
Figure 7:
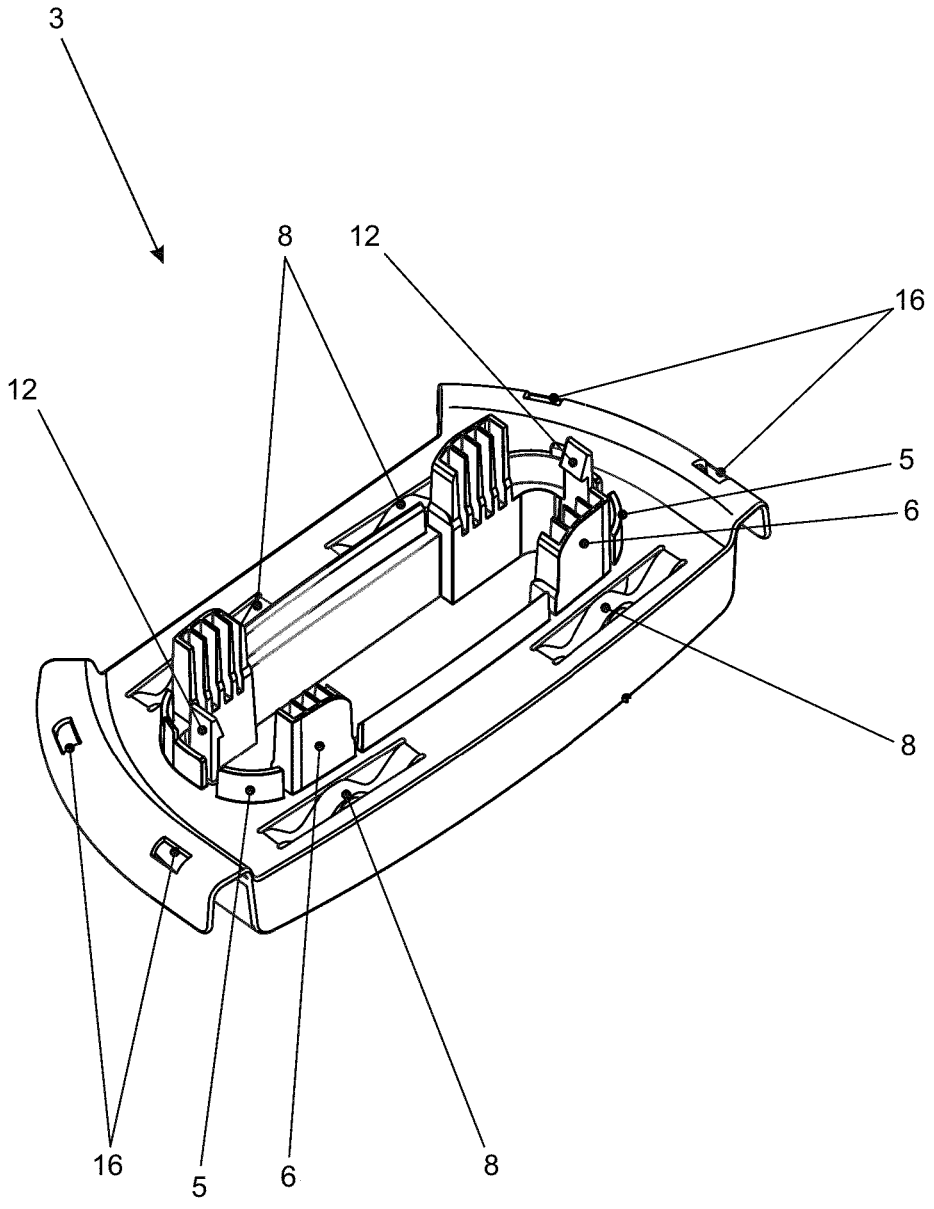
FIG. 7 is a three-dimensional view of a detail of the support.
Figure 8:
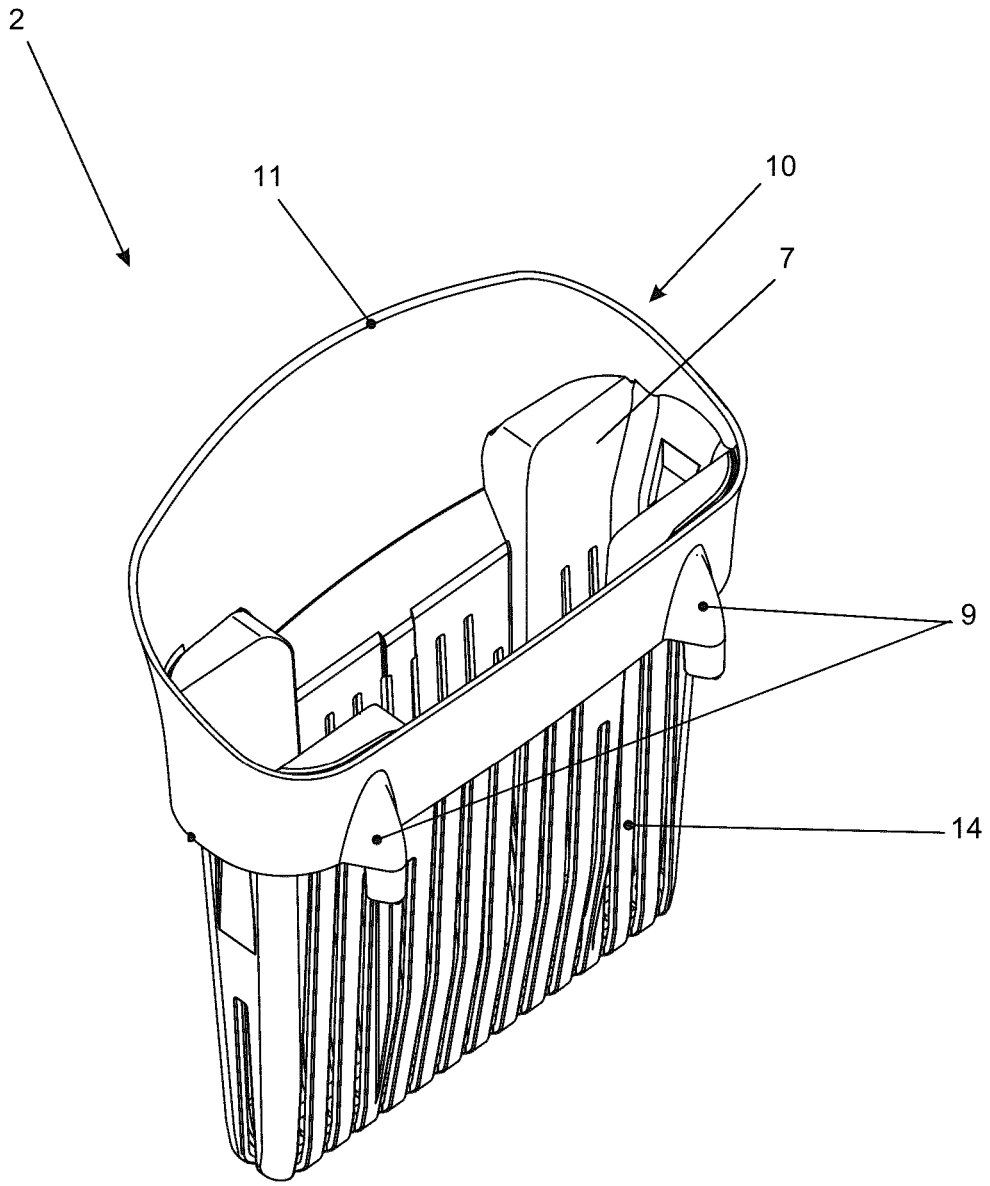
FIG. 8 is a three-dimensional view of a detail of the receptacle.

FIG. 5 is a front view of the wringer device 1. FIG. 6 is a side view of the wringer device 1. FIG. 7 shows a detail of the support 3, and FIG. 8 shows a detail of the receptacle 2.

Figure 9:
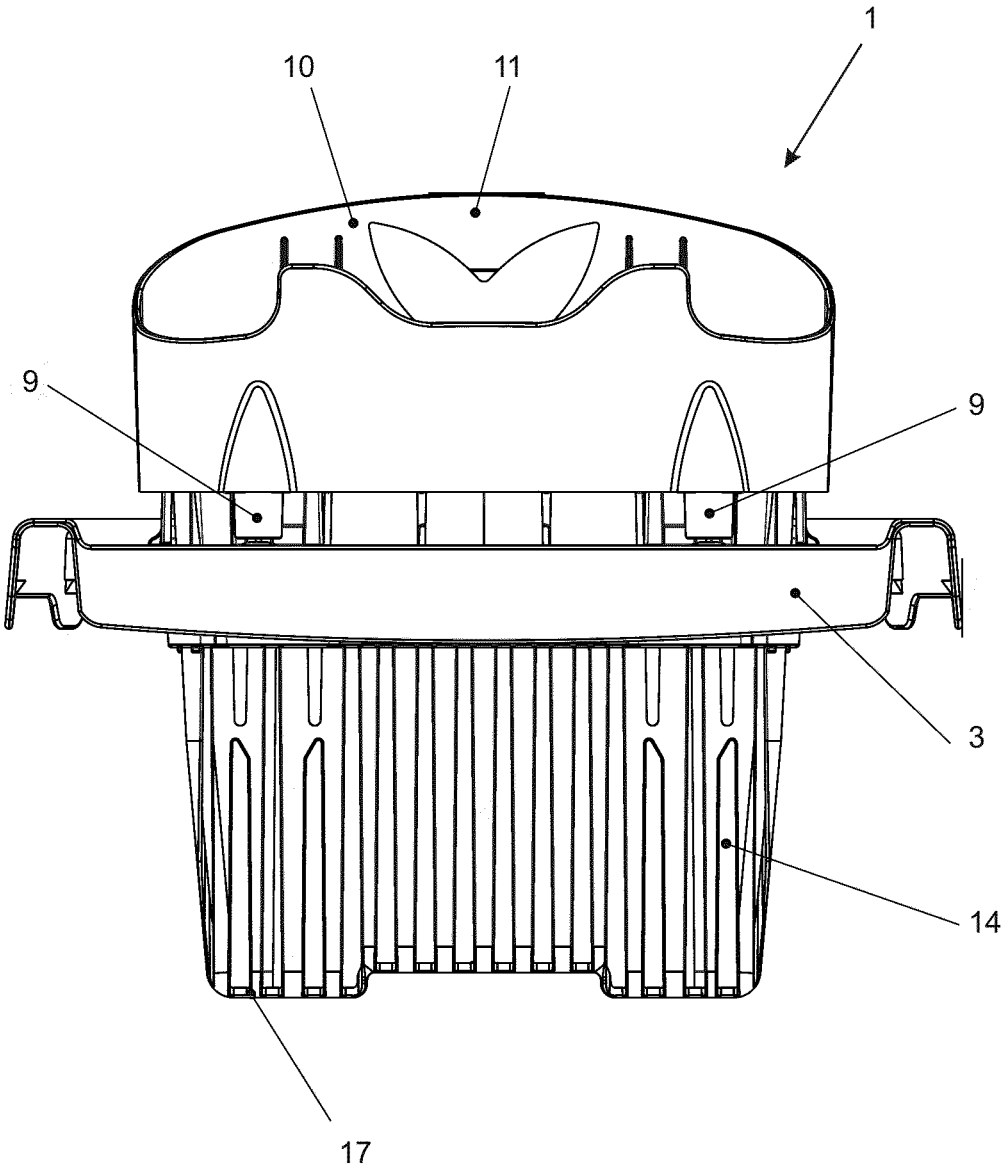
FIG. 9 is a front view of an alternative embodiment of the wringer device.
Figure 10:
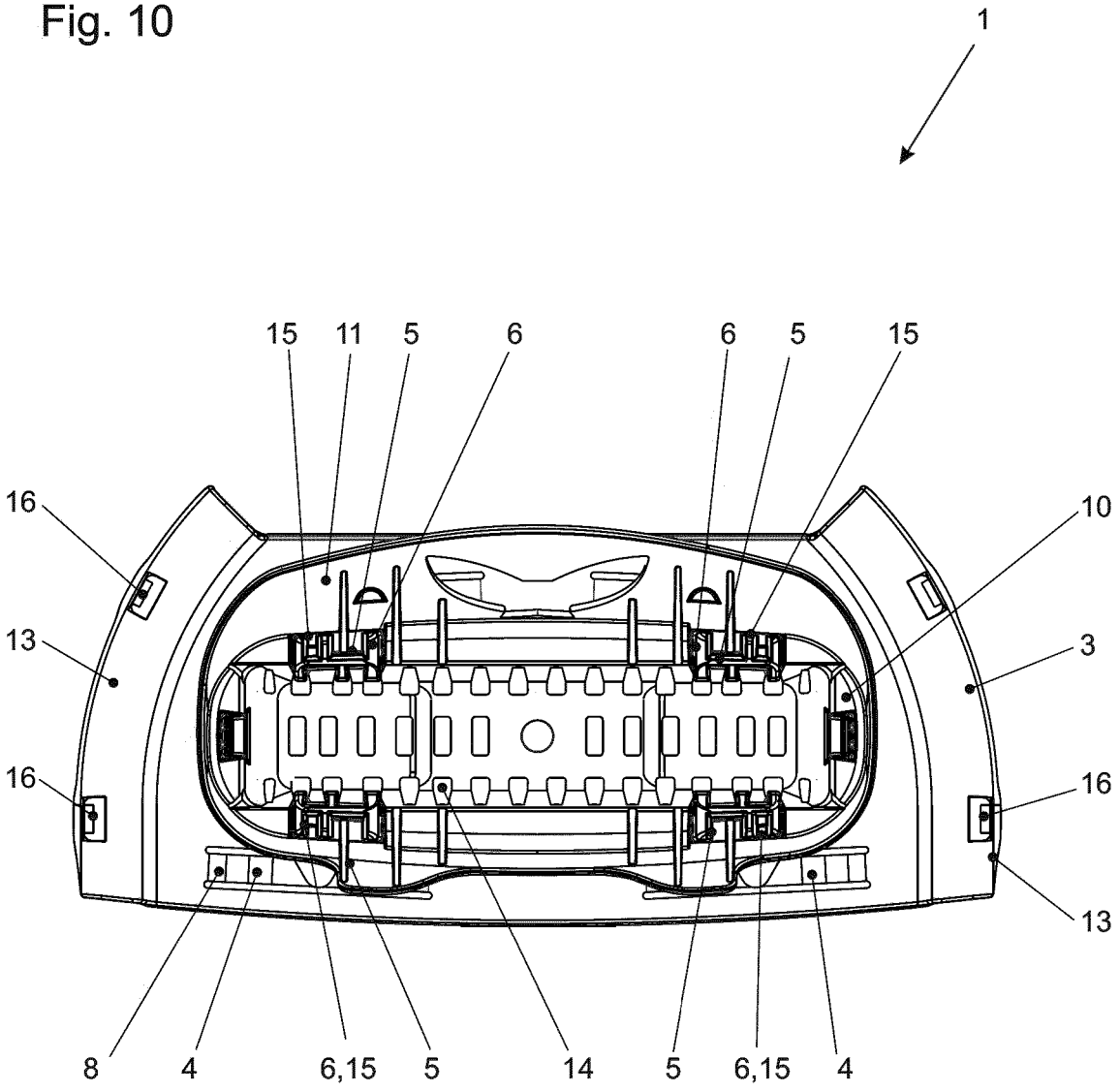
FIG. 10 is a plan view of the wringer device according to FIG. 9.

FIGS. 9 and 10 show an alternative embodiment of the wringer device 1. In this embodiment, the guide 5 is formed by columnar projections 6 which are formed integrally and in one piece from the support 3, and by apertures 15 which are made in the receptacle 2 and through which the projections 6 protrude into the inside of the receptacle 2. The depressions made in the receptacle 2 are omitted in this embodiment, and therefore the inner diameter of the basket-like receptacle 2 increases. As a result, bulky wet mops can be received and can be pushed deep into the receptacle 2. This improves the wringing power, and pushing the wet mop in deeply improves the stability of the mop system consisting of the mop bucket and the wringer device 1. The projections 6 are shaped such that a wet mop can be pushed into the receptacle 2, along the projections 6 protruding through the apertures 15.

The bottom 17 of the receptacle 2 comprises an elevation 18. Said elevation is preferably arranged centrally in the bottom 17 of the receptacle 2, so as to result in depressions on either side. This embodiment improves the wringing power of wet mops having a bordered edge. The edge, which is thickened by the bordering, is received in the depressions, and the portion that forms the mop surface of the wet mop comes into contact with the elevation 18.

Figure 11:
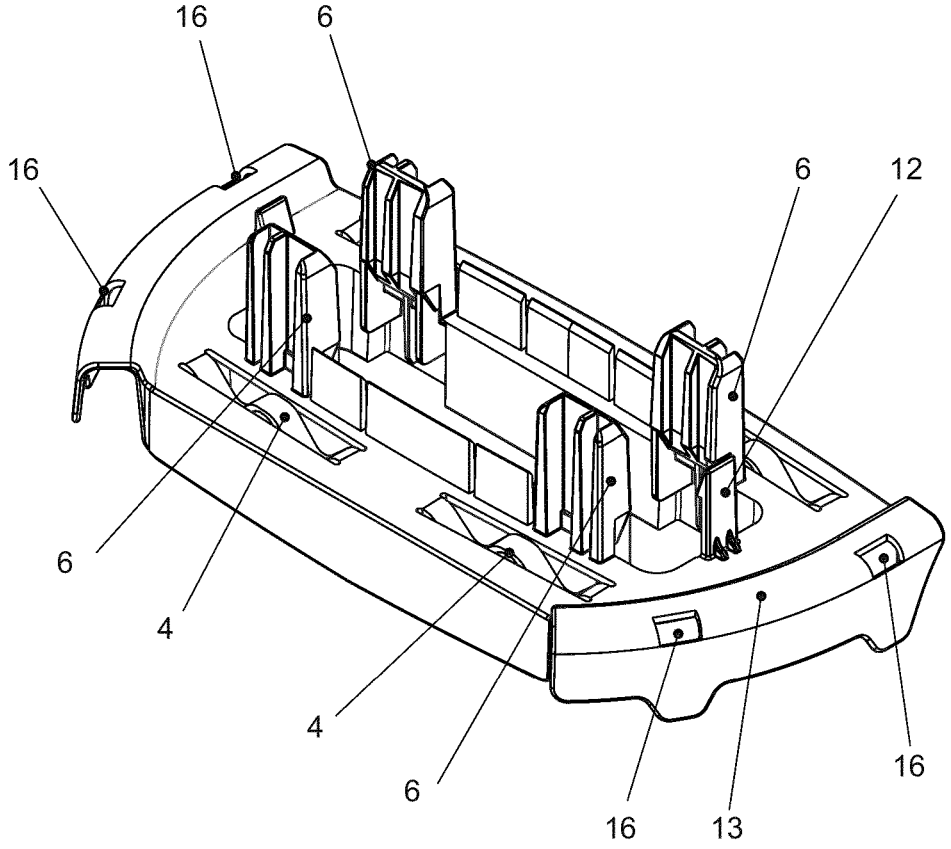
FIG. 11 is a three-dimensional view of a detail of the support of the wringer device according to FIG. 9.
Figure 12:
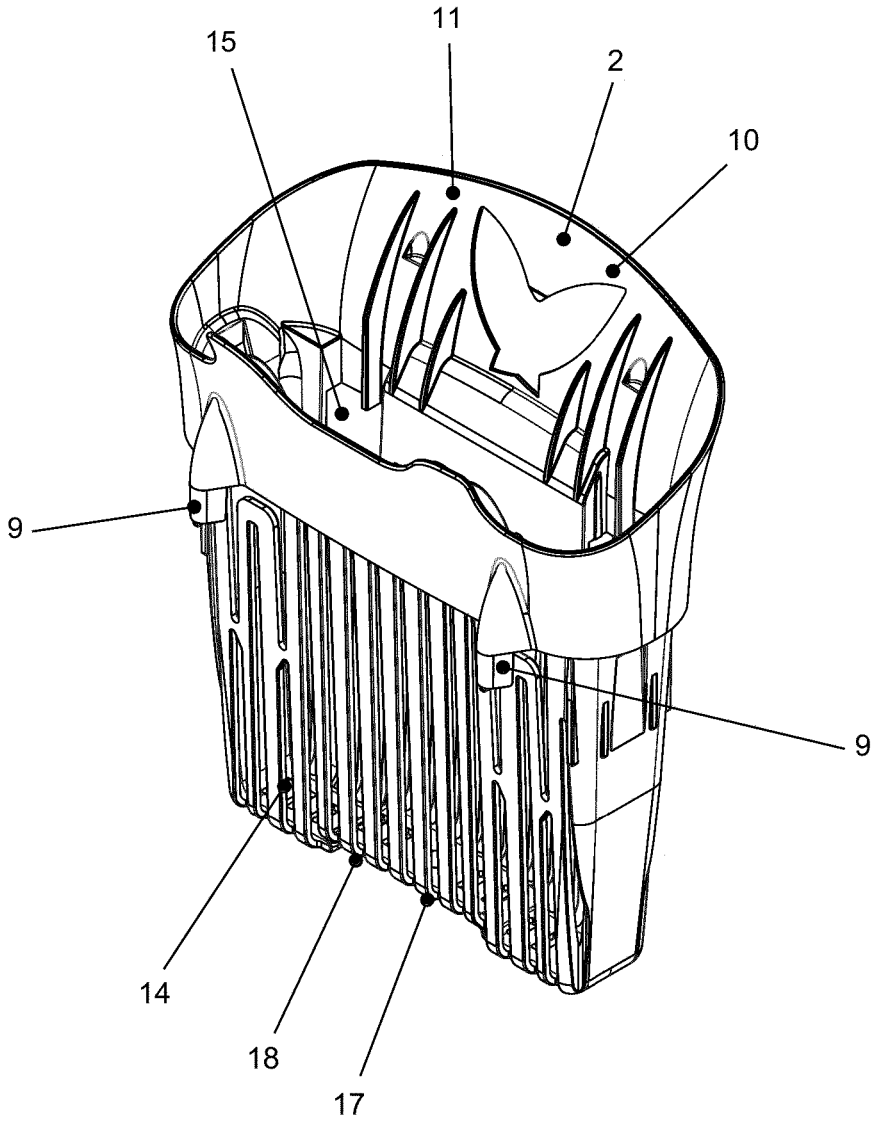
FIG. 12 is a three-dimensional view of a detail of the receptacle of the wringer device according to FIG. 9.

FIG. 11 shows a detail of the support 3, and FIG. 12 shows a detail of the receptacle 2.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A wringer device for a mop, comprising:

a basket-like receptacle in which the mop is configured to be wrung out by being pushed in;

a support configured to fasten the wringer device in a mop bucket; and a guide configured to permit translational movement of the receptacle relative to the support, the guide comprising columnar projections and depressions that are congruent to the columnar projections, wherein the receptacle is configured to be guided in the support such that the receptacle is movable in translation in an insertion direction of the mop between a first position in which the receptacle is spaced apart from the support and a second position in which the receptacle is in contact with the support.

2. The wringer device according to claim 1, wherein the receptacle is configured to be moved counter to a force of a spring.

3. The wringer device according to claim 1, further comprising spring elements configured to be deformed during relative movement of the receptacle when the mop is pushed in.

4. The wringer device according to claim 3, wherein the spring elements are formed from the support.

5. The wringer device according to claim 3, wherein the spring elements are assigned punching members configured to deform the spring elements when the receptacle moves.

6. The wringer device according to claim 1, wherein the receptacle is held in the support in an anti-loss manner by snap-in hooks.

7. The wringer device according to claim 1, wherein an opening of the receptacle is provided with a funnel-shaped rim that is higher on one side.

* * * * *